United States Patent [19]

Theobald et al.

[11] Patent Number: 4,947,594

[45] Date of Patent: Aug. 14, 1990

[54] DEVICE FOR ADJUSTING AND FIXEDLY SECURING WINDOW FRAMES AND DOOR CASES OR THE LIKE IN WALL OPENINGS

[75] Inventors: Thomas Theobald, Widdern; Manfred Kross, Iserlohn; Hans J. Plumer, Hemer, all of Fed. Rep. of Germany

[73] Assignee: ITW-Ateco GmbH, Norderstedt, Fed. Rep. of Germany

[21] Appl. No.: 299,373

[22] Filed: Jan. 23, 1989

[30] Foreign Application Priority Data

Jan. 20, 1988 [DE] Fed. Rep. of Germany ..... 3801475

[51] Int. Cl.[5] ..... E04F 21/00

[52] U.S. Cl. ..... 52/126.4; 33/194

[58] Field of Search ..... 52/126.4, 126.5, 749, 52/217; 33/194; 269/905

[56] References Cited

U.S. PATENT DOCUMENTS

| | | | |
|---|---|---|---|
| 2,748,493 | 6/1956 | Williams | 33/194 |
| 2,945,568 | 7/1960 | Chasteney | 52/126.4 |
| 2,949,948 | 8/1960 | Zern | 33/194 |
| 3,830,024 | 8/1974 | Warnke | 52/143 |
| 4,141,192 | 2/1979 | Augustine | 33/194 |
| 4,685,216 | 8/1987 | Woods | 33/126.4 |

FOREIGN PATENT DOCUMENTS

| | | | |
|---|---|---|---|
| 0124832 | 11/1984 | European Pat. Off. | |
| 1132243 | 3/1957 | France | 33/194 |

*Primary Examiner*—John E. Murtagh

*Attorney, Agent, or Firm*—Schwartz & Weinrieb

[57] ABSTRACT

A device for adjusting and fixedly securing window frames and door cases or the like within wall openings comprising at least one manually rotatable threaded shaft upon which a fixture is mounted and adapted to be connected with a portion of the frame, the fixture being supported upon a side wall of the wall opening, wherein the threaded shaft is directly supported upon the side wall of the opening by means of a thrust element at its free end, the fixture comprising a shaft nut portion, and wherein the fixture detachably grips the frame portion by means of support portions such that the frame can be fixedly secured with respect to the associated wall of the opening, and is also transversely displaceable.

9 Claims, 2 Drawing Sheets

DEVICE FOR ADJUSTING AND FIXEDLY SECURING WINDOW FRAMES AND DOOR CASES OR THE LIKE IN WALL OPENINGS

FIELD OF THE INVENTION

This invention relates to a device for adjusting and fixedly securing window frames and door cases or the like within wall openings.

BACKGROUND OF THE INVENTION

Wall openings into which window frames or door cases are inserted usually have an inside width which more or less exceeds the outer dimensions of the frame or case, respectively. Therefore, the pre-fabricated case or frame, respectively, has to be adjusted within the wall opening with respect to three orthogonal axes prior to being finally fixedly secured therein. It is known to fixedly secure the frames or cases, respectively, within the wall opening by means of base pieces and/or wedges in accordance with the positional adjustment process. This procedure is cumbersome and time-consuming. Also the removal of the wedges and base pieces after the final securing of the frame or case, respectively, proves to be relatively cumbersome.

It is known to secure cases or frames, respectively, which are adjusted and fixedly secured within the wall opening by means of bolts with elongated shafts, the threaded bolts also forming threaded holes within the side walls of the holes predrilled within the frame whereby the frame is secured at all sides in its relative position by means of the bolts. Prior to the positioning of the bolts a drilling hole is defined within the wall material through means of the drilling holes within the frame. Therefore, the drilling holes within the frame serve as a drilling gauge. If during these mounting operations the frames are not fixedly secured, it may easily happen that they are moved away from their previously position. The consequence is a cumbersome renewed adjustment process.

It is known from EP-A-0 124 832 to engage at least one screw clamp with the frame or case, respectively, for adjusting and securing window frames and door cases. The screw clamp is supported upon a carrying sling which is secured to the wall material by means of an additional screw clamp. It is a disadvantage of this known device that the securing device grips a rear surface of the wall material and therefore can only be utilized for the mounting of frames or cases, respectively, within the so-called wall rabbet type systems. It is a further disadvantage that for a lateral displacement the screw clamp engaged with the frame or case, respectively, initially has to be released. Consequently, a change in the support of the window frame may result which might impair the finished adjustment process. At the least the adjusting operation becomes expensive.

OBJECT OF THE INVENTION

It is the object of the invention to provide a device for adjustment and fixedly securing window frames and door cases or the like which enables an exact adjustment and fixed securing of the window frames and door cases at any position of the frames and cases.

SUMMARY OF THE INVENTION

According to the invention, this object is attained by the features which will be more fully set forth and described in the detailed description of this application as will appear subsequently.

In accordance with the device constructed with according to the invention a threaded shaft is provided which is directly supported upon the side wall by means of a thrust element. The thrust element is preferably rotatably supported at the free end of the threaded shaft. The fixture is positioned upon the shaft by means of a shaft nut portion. By rotating the threaded shaft, complete fixture is therefore axially adjusted with respect to the shaft. The fixture laterally overgrips the frame portion by means of support portions in such a way that the frame or case, respectively, is fixedly secured with respect to the associated wall of the opening, however, the fixture, threaded shaft, and thrust element are transversely displaceable with respect to the frame or case.

By means of the extremely simple device constructed according to the invention, a frame or case, respectively, may be raised or lowered by rotating the threaded shaft as is required by the desired end position. In addition, the frame or case, respectively, may be laterally displaced within the fixture. The position of the frame or case, respectively, with respect to the plane of the opening of the wall is therefore adjusted by means of the threaded shaft, whereas the transverse position may be adjusted by displacing the frame or case, respectively, within and relative to the fixture.

The device constructed according to the invention also has the advantage that it can be used regardless of how the frame is to be mounted in relation to the opening of the wall along an axis perpendicular thereto. The application of the device constructed according to the invention also is independent of all kinds of walls and rabbets. The device constructed according to the invention, however, takes advantage of the fact that the frame normally comprises a sufficient inherent stability such that a deformation during or after the adjustment process will not occur.

It is possible to provide two fixed support portions upon the fixture, the distance between which approximately corresponds to the width of the frame or case profile. As the case or frame profile comprises certain tolerances, the distance, however, has to be selected in such a way that it is somewhat larger than the frame or case dimension, respectively, plus the allowable tolerance. Admittedly, therefore, a certain slack would result which is disadvantageous for an exact securing fixation or location of the frame or case. Therefore, an embodiment of the invention provides that the fixture comprises a fixedly attached support portion preferably facing the wall of the opening while the other support portion is defined by means of a resilient portion of the fixture. The resilient portion permits a more or less fixed engagement of the frame or case portion from opposite thereof, however, at the same time, permits removal of the fixture without any problems. The resilient portion is preferably defined by means of a leaf spring in accordance with an additional embodiment of the invention, the leaf spring being connected with the fixture and engaging the facing frame surface. In many cases, the inner surfaces of the window frames or door cases comprise raised edges or the like. In accordance with an additional embodiment of the invention, the leaf spring may comprise a projection which engages behind a raised edge of the frame or case.

As the frames or cases, respectively, may comprise different dimensions, it is advantageous according to a further embodiment of the invention that the distance defined between the support portions is made adjustable. Preferably, the resilient portion is adjustable. As an example, the adjustment may be accomplished such that the resilient portion is secured upon the fixture by means of a bolt which is positioned within an elongated aperture of the fixture. Preferably, the fixture comprises a planar plate within which one or two elongated apertures are defined. Furthermore, the plate may be adapted to engage the front side of the frame portion so as to secure the plate to the frame in a direction extending along an axis perpendicular to the plane of the opening.

In order to prevent the portions of the fixture engaging the frame from scratching the frame portion or otherwise damaging it, an embodiment of the invention provides that the surfaces contacting the frame portion are covered with a relatively soft coating, such as, for example with a suitable plastic coating.

BRIEF DESCRIPTION OF THE DRAWINGS

Subsequently, the invention will be explained in more detail when referring to an example depicted in the drawings in which like reference characters designate like or corresponding parts throughout the several views, and wherein.

DETAILED DESCRIPTION OF THE ILLUSTRATED EMBODIMENT

Figure 1:
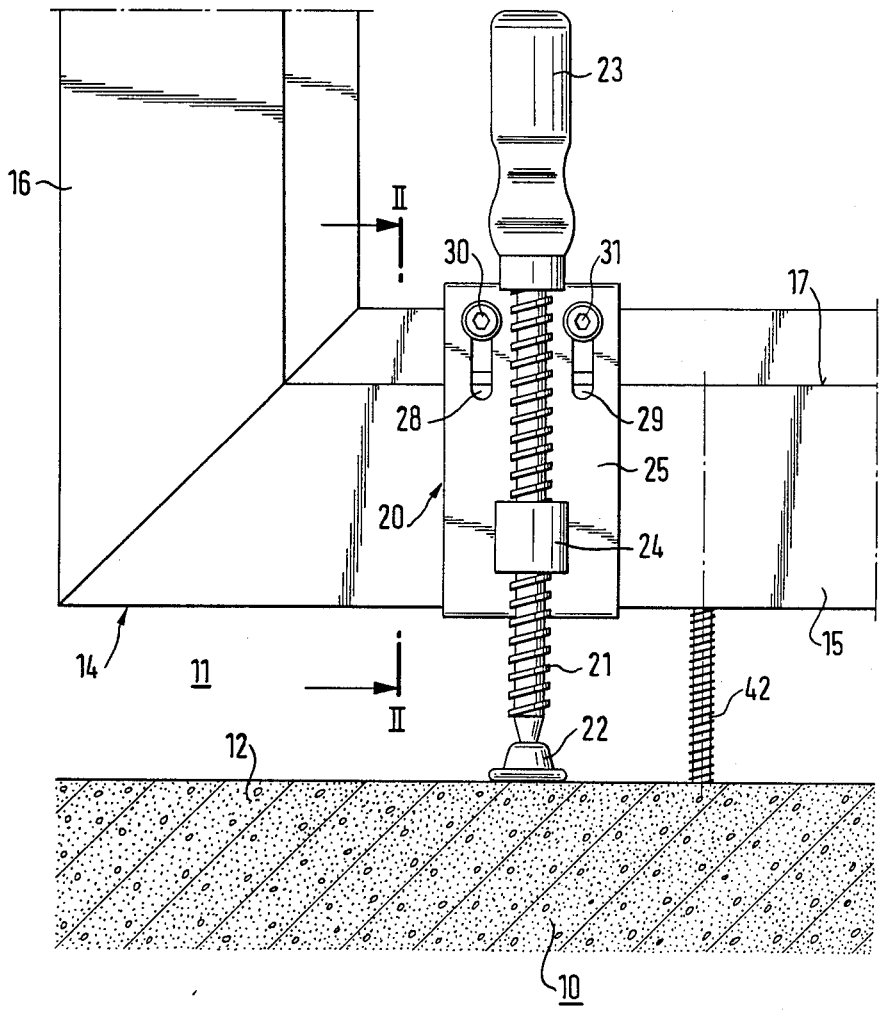
FIG. 1 is a front view of a device according to the invention engaging a partly depicted window frame or door casing, respectively.

Before referring more particularly to the details shown in the drawings, it is stated that each of the described features per se or in combination with features of the claims is of significance for the invention.

Figure 2:
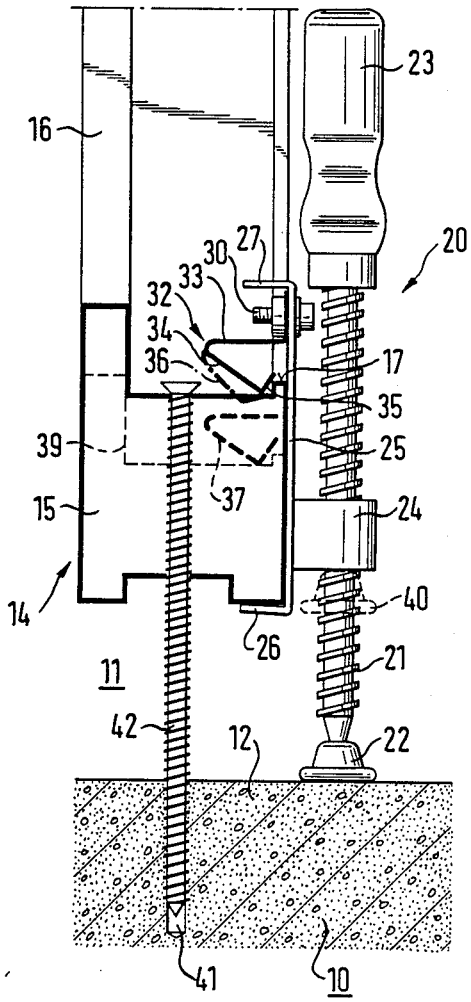
FIG. 2 is a section through the device in FIG. 1 along the line II—II in FIG. 1.

In FIGS. 1 and 2, a wall material is indicated by means of the numeral 10. It comprises an opening 11 in connection with which a wall 12 defining the opening is shown. A horizontal frame portion 15 of a window frame or door casing 14 can be seen which is only partially indicated, the horizontal frame portion being rectangularly connected with a vertical frame portion 16. In FIG. 2 the profile of the frame is to be seen. Furthermore, it is shown that it comprises a peripherally extending raised edge 17 located upon the inner side thereof.

In FIGS. 1 and 2 an adjusting and securing device 20 is also shown. It comprises a threaded shaft 21 which is supported upon the wall 12 of the opening by means of a thrust element 22 rotatably connected with the end of the threaded shaft 21. At the other end the threaded shaft comprises a handle 23. The threaded shaft 21 extends through a nut portion 24 which is provided at the outer side of a plate 25 which comprises angular portions 26, 27 at the upper and lower ends thereof. The angular portions 26, 27 face away from the nut portion 24. As shown in FIG. 2, the lower angular portion 26 defines a fixed suport. The portions 26, 27 define a distance from between each other which is larger than the maximum width or height, respectively, of the profiled ledges for the window frames or door cases. As can be seen also in FIG. 1, the plate 25 comprises two elongated apertures 28, 29 in its upper end portion through which locking screws 30, 31 are guided for securing a leaf spring 32 upon the inner side of the plate 25. A horizontal portion 33 extends from the secured portion of the leaf spring 32, the horizontal portion being bent backwards at an acute angle and defining a resilient leg 34 which at its end is bent rectangularly and comprises an engagement portion 35. The portions 34, 35 define a downwardly directed projection resilient and yieldingly engaging the inner surface of the frame 14, the ledge or raised edge 17 being engaged from the rear surface thereof. The released condition of the leaf spring 32 is indicated by means of the dash-dotted line 36. Indicated by means of the dash-dotted line 37 are the locking screws 30 which have brought the leaf spring 32 into another position for engagement with a frame portion of different dimensions as is indicated by means of the dash-dotted line at 39.

It is obvious that the fixture defined by means of the supports 26 and 32 and the plate 25 may be adjusted to the dimensions of the frame portions. The fixture may simply be snapped onto the frame and also be released therefrom. When snapping the same onto the frame, the threaded shaft 20 is threadedly retracted somewhat as is indicated by means of the dash-dotted line at 40. Subsequently, the height adjustment of the frame 14 is accomplished by means of the device 20 by raising or lowering the frame 14 wherein preferably at least two devices 20 of the same kind are provided upon the frame 14. When the height adjustment is attained, the lateral adjustment of the frame is accomplished by displacement within its fixture until the exact position is reached. Subsequently holes are drilled into the wall material 10 by means of a drill as can be seen at 41 as an example. The drill holes within the profile of the frame serve as drilling gages for this procedure. Subsequently, a bolt 42 with an elongated shaft is screwed into the drilling hole 41 within the wall from its disposition within the frame profile, the thread upon the bolt 42 also defining a thread within the hole of the frame profile such that by means of such bolts 42 the frame 14 is finally secured at the position adjustably selected by means of the device 20. By simply tilting the device 20, the fixture may be re-leased from the frame portion.

Obviously, many modifications and variations of the present invention are possible in light of the above teachings. It is therefore to be understood that within the scope of the appended claims, the present invention may be practiced otherwise than as specifically described herein.

We claim:

1. A device for adjusting and fixedly securing a window frame, door case, or the like, having a predetermined length dimension as defined along a longitudinal axis extending between first and second opposite ends thereof, with respect to a side wall surface of a wall opening, comprising:

fixture plate means, having a load supporting surface disposed parallel to said side wall surface of said wall opening and engaged in surface-to-surface contact with a surface of said window frame, door case, or the like, such that said window frame, door case, or the like, is slidably adjustable with respect to said fixture plate means and said side wall surface of said wall opening along the entire length of said window frame, door case, or the like, in a first direction extending along said longitudinal axis thereof;

nut means fixedly mounted upon said fixture plate means; and a threaded shaft rotatably adjustable within said nut means and having one end thereof engageable with said side wall surface of said wall opening so as to adjustably support said fixture plate means, and said window frame, door case, or the like, supported thereby, at a predetermined position relative to said side wall surface of said wall opening in a second direction perpendicular to said first direction.

2. The device according to claim 1, characterized in that:

said fixture plate means comprises said load supporting surface which defines a fixedly attached support portion (26) facing said side wall surface (12) of said wall opening, and another support portion defined by means of a resilient portion (32) of said fixture plate means.

3. The device according to claim 2, characterized in that:

said resilient portion (32) comprises a leaf spring connectable with said fixture plate means, said spring being engageable with a facing frame surface by means of a bent portion (34,35) thereof.

4. The device according to claim 3, characterized in that:

said leaf spring comprises a projection which engages behind a raised edge (17) of said window frame, door case, or the like (14).

5. The device according to claim 2, characterized in that:

said another support portion (32) is adjustable.

6. The device according to claim 3, characterized in that the resilient portion (32) is adjutable.

7. The device according to claim 2, characterized in that the support portions (26, 32) are secured to a plane plate (25) an outer side of the window frame, door case, or the like being adapted to engage the plate.

8. The device according to claim 7, characterized in that the plate (25) comprises at least one elongated aperture (28, 29) to receive a locking screw (30, 31) adapted to be connected with the resilient portion (32).

9. The device according to claim 1, characterized in that surface portions of said fixture plate means having contact with said window frame, door case, or the like, portion are covered with a relatively soft coating.

* * * * *